United States Patent [19]

Schwarz

[11] 4,025,889

[45] May 24, 1977

[54] NON-RESETTABLE HEAT RESPONSIVE SAFETY SWITCH

[75] Inventor: Gerhard Schwarz, Pforzheim, Germany

[73] Assignee: Firma Microtherm GmbH, Pforzheim, Germany

[22] Filed: Sept. 8, 1975

[21] Appl. No.: 611,430

[30] Foreign Application Priority Data

Sept. 19, 1974 Germany ..... 2444802

[52] U.S. Cl. ..... 337/408; 337/409

[51] Int. Cl.[2] ..... H01H 37/76

[58] Field of Search ..... 337/408, 407, 401, 402, 337/403, 404, 411, 409, 413, 148, 10

[56] References Cited

UNITED STATES PATENTS

| | | | |
|---|---|---|---|
| 3,727,164 | 4/1973 | Cartier et al. | 337/409 |
| 3,820,050 | 6/1974 | Tyler et al. | 337/408 |
| 3,821,685 | 6/1974 | Kimball et al. | 337/409 |

*Primary Examiner*—Harold Broome
*Attorney, Agent, or Firm*—Joseph A. Geiger

[57] ABSTRACT

A non-resettable heat responsive safety switch featuring two contact sleeves inside a jacket with a displaceable intermediate contact body of metal granulate, a preloaded compression spring biasing the contact body in the direction of contact interruption, a normally solid trigger body of fusible material holding the contact body in its normal, sleeve-bridging position, against the spring bias, until, at a critical temperature level, the trigger body yields to the spring which moves the contact body and breaks contact in the switch.

11 Claims, 4 Drawing Figures

NON-RESETTABLE HEAT RESPONSIVE SAFETY SWITCH

BACKGROUND OF THE INVENTION

1. Field of the Invention

The present invention relates to electrical safety components for the protection of equipment and appliances against overheating, and more particularly to non-resettable safety switches which, when triggered by excess heat, shut down the source of overheating by interrupting an electrical line, and which thereafter must be replaced, in order to reconnect that electrical line.

2. Description of the Prior Art

One non-resettable heat responsive safety switch of this type is disclosed in U.S. Pat. No. 3,821,685. This known device comprises a glass cylindrical envelope having lead-in wires on each end, a conical end closure being connected to one of the lead-in wires, and a matching longitudinally slotted contact shell being connected to the other lead-in wire. This contact shell remains engaged against the conical end closure as long as a packing of fusible granulate, which backs up the contact shell against a compression spring, remains solid and resists the bias of the compression spring. The latter, when allowed to expand as a result of softening and/or fusion of the granulate packing, withdraws the contact shell from the conical end losure, thereby permanently interrupting the connection between the lead-in wires.

This type of non-resettable thermal safety switch is intended to eliminate the risk encountered with conventional bimetallic switches, where the contact points can fuse together as a result of arcing, or where the temperature setting can be deliberately or accidentally distorted so as to render the device ineffective. One shortcoming of the mentioned prior art device is that, under borderline temperatures, the contact between the cooperating conical end closure and the shell, relying on the radial resiliency of the latter, becomes indefinite, instead of remaining intact or being permanently interrupted.

Additional shortcomings of the prior art device relate to its complexity of design, requiring comparatively expensive component parts and stringent quality controls in manufacture and assembly.

SUMMARY OF THE INVENTION

It is a primary objective of the present invention to provide an improved safety switch of the above-mentioned type which, while being reliable in operation, is extremely simple in design and inexpensive to manufacture as a mass-produced standardized component.

In order to attain the above objective, this invention suggests a non-resettable heat responsive safety switch in which substantially identical contact sleeves reach into an insulating outer jacket of the device, and a packing of conductive granulate normally extends into the end portions of both sleeves, thereby establishing the normal operating contact. Inside one of the two sleeves is arranged a plunger of nonconductive material, biased against the metal granulate packing by a compression spring so that, when the fusible granulate becomes compressible after acquiring a given temperature, the spring loaded plunger extrudes the metal granulate packing from the associated conductive sleeve, thereby breaking contact.

A particular characteristic of the present invention is that a packing of metallic granulate is used to establish normal contact between the axially spaced contact sleeves. The heat responsive trigger element may be a fusible granulate packing arranged axially behind the conductive granulate packing, in the sense of the spring bias. Alternatively, the fusible granulate and the conductive metal granulate may form a single composite granulate packing.

In another preferred embodiment of the invention, the heat responsive triggering element is mounted on the forward end of a cavity, in a mounting arrangement which yields at the crucial temperature, whereupon the triggering element and the conductive granulate packing normally held in place by it are displaced into that cavity under the action of the compression spring.

In comparison with the known prior art device, the proposed novel component is simpler and more compact in design, using the sleeves around the lead-in wires as conductors and eliminating the special contact components (end closure and shell) which require flexibility of at least one of them, in order to establish a good contact. The component parts of the proposed safety switch are thus extremely simple and few in number, with the result that they can be economically massproduced. The use of a packing of conductive granulate as a contact body, taking the place of multiple contact interfaces in the prior art device, accordingly eliminates several important manufacturing and assembly tolerances, thereby also greatly simplying the assembly operation.

As part of the facilitation of assembly, the present invention further suggests that the two contact sleeves be provided with peripheral collars in the form of integral wall pleats which serve to axially anchor the contact sleeves inside the insulating outer jacket. The latter is conveniently produced from a thermo-setting plastic material, in an injection molding operation. The outer end portions of the contact sleeves are preferably arranged to protrude from the jacket. Into these protruding portions are inserted the ends of the lead-in wires, the latter being permanently secured in a swaging operation. The resulting structure is extremely simple and robust, being also very compact in its overall dimensions.

BRIEF DESCRIPTION OF THE DRAWINGS

Further special features and advantages of the invention will become apparent from the description following below, when taken together with the accompanying drawings which illustrate, by way of example, several embodiments of the invention, represented in the various figures as follows.

DESCRIPTION OF THE PREFERRED EMBODIMENTS

Figure 1:
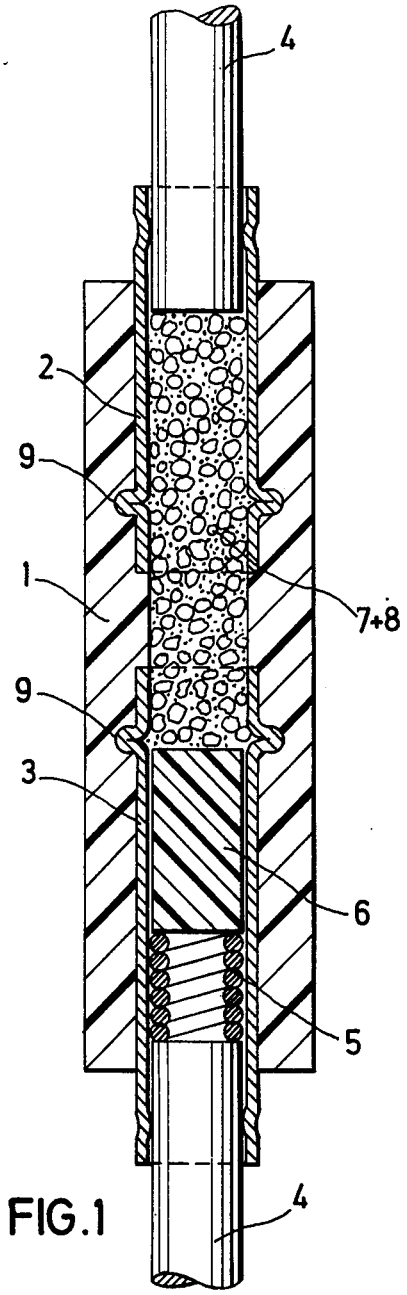
FIG. 1 shows an enlarged longitudinal cross section of a heat responsive safety switch, representing a first embodiment of the invention.
Figure 2:
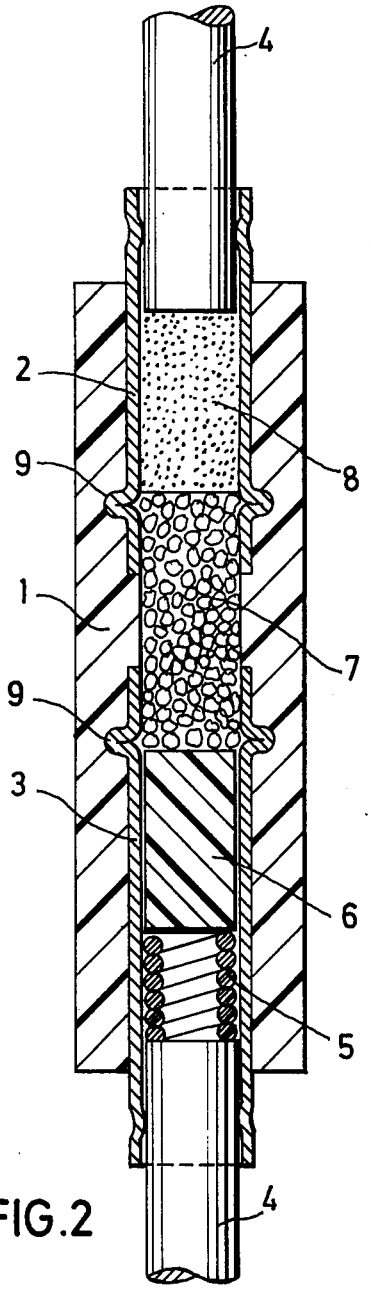
FIG. 2 shows a similar, second embodiment of the invention.

Referring first to FIGS. 1 and 2, which are similar in many respects, there can be seen two non-resettable heat responsive safety switches representing two embodiments of the present invention. The device consists typically of an outer, generally cylindrical jacket 1 of non-conductive material, holding in its longitudinal axis a contact sleeve 2 and a somewhat longer contact sleeve 3, both sleeves being metal tubes and therefore electrically conductive. The two contact sleeves are arranged in coaxial alignment in the longitudinal center axis of the jacket 1, being axially spaced apart at their inner extremities, while an outer end portion of each sleeve protrudes axially from the jacket 1. Except for their different lengths, the two sleeves are identical in structure, it being also possible, of course, to utilize entirely identical contact sleeves on both sides of the device. Each sleeve has a circumferential collar 9 near its inner extremity formed as an outwardly folded pleat of the sleeve wall.

For production and assembly purposes, the insulating jacket 1 and the two contact sleeves 2 and 3 form a sub-assembly, the jacket 1 being preferably injection molded around the two contact sleeves which, during this operation, are seated on a suitable mandrel. The jacket 1 must be electrically non-conductive and heat resistant. Preferred among materials with these characteristics are thermo-setting synthetic plastics, materials such as glass and ceramics being likewise suitable. Into the protruding end portion of each contact sleeve is inserted an end portion of a lead-in wire 4, the sleeve end portion being thereafter swaged over the lead-in wire, thereby creating a solid mechanical and electrical connection between the wires 4 and the contact sleeves 2 and 3, respectively.

The extremities of the lead-in wires 4 confine between them the actual switching parts of the device consisting of a compression spring 5, a cylindrical plunger 6 of non-conductive material, and packings of conductive metallic granulate 7 and non-conductive fusible granulate 8. The conductive granulate 7 occupies in each case an axial length portion of both contact sleeves, thereby establishing an electrical connection between them. The pressure exerted by spring 6 against the granulate packing assures the maintenance of a good contact.

As the drawing indicates, the only difference between the embodiments of FIG. 1 and FIG. 2 resides in the arrangement of the fusible granulate 8 in relation to the conductive metal granulate 7. In FIG. 1, the two granulates are provided in the form of a granulate mixture 7/8; in FIG. 2 they are provided in the form of separate axially abutting packings. In the latter case, the conductive granulate packing 7 occupies the center of the jacket cavity, engaging short end portions of each contact sleeve, while the fusible granulate packing 8, preferably in the form of a solid pellet, occupies the axial space between the conductive packing 7 and the extremity of one of the lead-in wires 4.

The electrical current flows in both cases from one of the lead-in wires 4 to its associated contact sleeve 2 and 3, respectively, and over the conductive granulate packing 7 to the other contact sleeve and associated lead-in wire 4. This conductive state is normally maintained indefinitely, so long as the temperature of the device remains below a critical temperature at which the fusible granulate packing 8 loses its mechanical resistance through softening and/or fusion.

The establishment of a temperature at or above the fusing temperature of the granulate packing 8 causes the latter to yield under the compressive force exerted against it by spring 6, whereupon the fusible granulate 8 undergoes a reduction in volume, both in the case of the composite granulate 7/8 of FIG. 1 and in the case of the separate fusible granulate packing 8 of FIG. 2. This volumetric change in the fusible granulate packing allows the compression spring 5 to expand against the packing, pushing the plunger 6 ahead of it, and thereby extruding the conuctive granulate packing 7 from the contact sleeve 3, to break the electrical contact between the two sleeves. The change in volume of the fusible granulate packing 8 requires either a vacuum between the granular particles, or the possibility for air to escape from the device, or to shift within the device. The latter is made possible through the permeability of the conductive granulate packing 7 and through a radial clearance between the plunger 6 and the surrounding contact sleeve 3. Still another advantageous possibility of operation, suited especially for the embodiment of FIG. 1, foresees the reverse extrusion of the fused non-conductive material from the packing 8 through the annular gap between the contact sleeve 3 and the advancing plunger 6 into the space occupied by the compression spring 5. The fused non-conductive material thereby performs a spark extinguishing function, as the plunger 6 extrudes the conductive granulate packing from the sleeve 3, moving beyond the extremity of the latter and interrupting the current flow.

The composite granulate packing 7/8 has the additional advantage of good heat conductivity from the outside to the particles of the fusible granulate 8, because of the intimate contact between the latter and the particles of the conductive granulate 7. This feature enhances the speed of response to a heat build-up in the area surrounding the safety switch.

The embodiment of FIG. 2, featuring separate packings of conductive granulate 7 and fusible granulate 8, responds to overheating in a way which is similar to that previously described in connection with the embodiment of FIG. 1. Depending upon the structure of the two granulate packings, the volumetric compressibility of the fusible packing 8 may be the result of air escaping from the packing either across the conductive granulate packing 7, or axially to the outside along the lead-in wire 4. Alternatively, the fused material of the packing 8 may itself penetrate into the interstices between the particles of the metal granulate 7.

Figure 3:
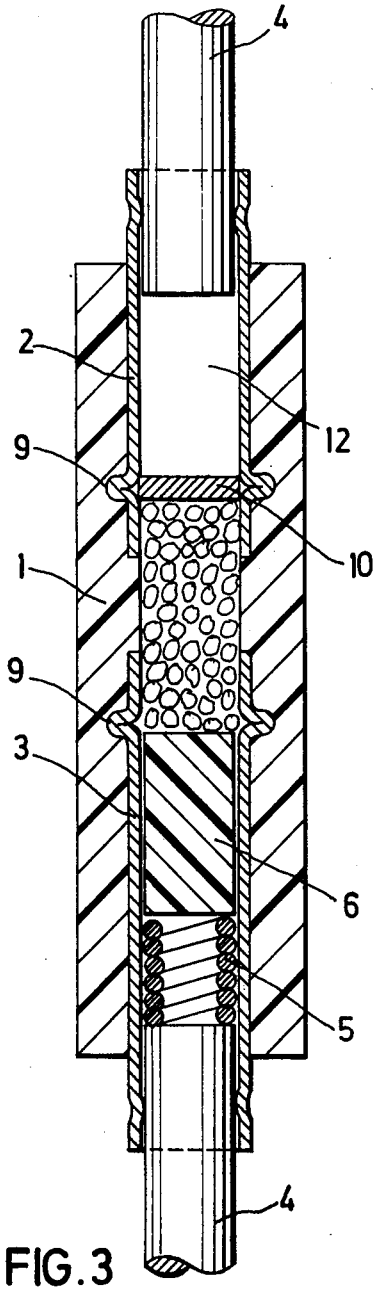
FIG. 3 shows a third embodiment of the invention.

In FIG. 3 is illustrated a third embodiment of the invention, where the previously employed non-conductive fusible packing 8 has been replaced by a fusible trigger disc 10. As long as it remains in the solid state, the trigger disc 10 serves as an axial barrier and abutment member for the conductive granulate packing 7 which again occupies a central position between the contact sleeves 2 and 3, reaching into the end portions of both. The trigger disc 10 is so arranged that a small peripheral radial overlap configuration with a groove arranged inside the contact sleeve 2 holds the disc in place, against the axial pressure of spring 5. Once the critical temperature is reached or exceeded, the thrust supporting peripheral portion of the trigger disc 10 quickly yields, whereupon the axial column consisting of the disc itself, the conductive packing 7, and the plunger 6, is thrust in the direction of spring pressure, for a clean and quick interruption of the current. The radial groove supporting the fusible trigger disc 10 inside the contact sleeve 2 is conveniently associated with the collar pleat of the latter. The disc itself may be made of a eutectic solder metal which softens and fuses at the critical temperature.

Figure 4:
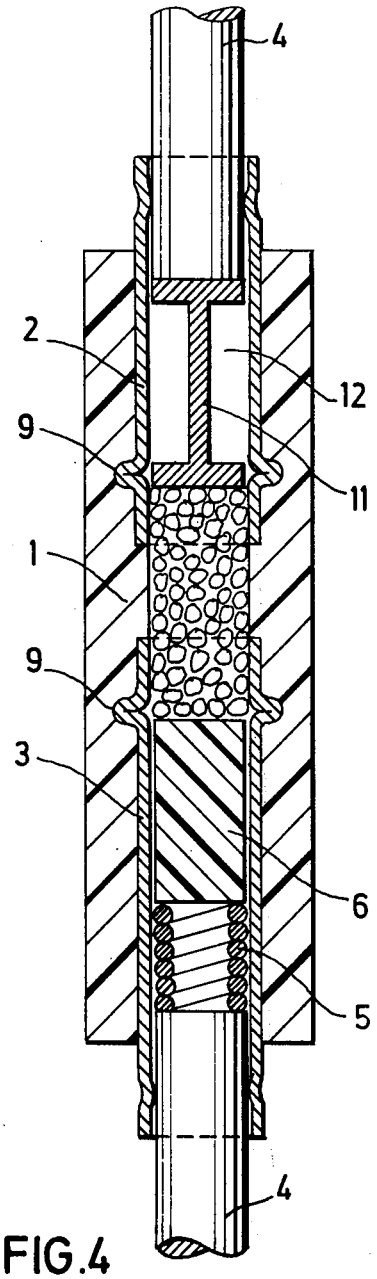
FIG. 4 shows a fourth embodiment of the invention.

In a fourth embodiment of the invention, illustrated in FIG. 4, there is again provided a trigger body forming an axial barrier against the conductive granulate packing 7, at a distance from the lead-in wire 4. But, instead of using a peripheral groove to axially retain the trigger disc 10', the latter is supported on a central stem extending axially from the disc 10' to a similar disc engaging the end face of the lead-in wire 4. This trigger body 11 has in this case the shape of a double mushroom, axially spaced head portions being linked by a central stem. Responding to overheating, the trigger body 11 simply collapses axially at its stem, the disc 10', the conductive granulate 7, and the plunger 6 executing again a rapid contact breaking motion under the effect of spring 5. In this context, it will be readily understood that the double-mushroomshaped trigger body 11 could be provided as a composite part, using fusible material for the stemp portion only, while the disc portions on both extremities serve to center the stem portion and to confine the granulate packing 7.

Instead of using a metal granulate for the conductive packing 7, it is also possible to use a filling of small metal spheres, the latter having the advantage of responding to the spring-generated axial preload by creating an even contact pressure at all points of engagement with the contact sleeves 2 and 3. Alternatively, it is also possible to use a contact body of solid metal, provided such a body is radially flexible to the extent of establishing contact with both contact sleeves, while permitting sliding disengagement from one of the sleeves. Such flexibility is obtainable, for example, with a longitudinally slotted tubular body.

Lastly, it should be understood, that the foregoing disclosure describes only preferred embodiments of the invention and that it is intended to cover all changes and modifications of these examples of the invention which fall within the scope of the appended claims.

I claim the following:

1. A non-resettable heat responsive safety switch breaking an established contact, when a critical temperature is reached or exceeded in the area of the switch, the latter comprising in combination:
   - a pair of tubular contact sleeves of electrically conductive material;
   - a non-conductive jacket holding the two contact sleeves in coaxial alignment with one another and axially spaced apart to form a gap between their inner ends;
   - a pair of lead-in wires attached to and electrically connected to the outer ends of the two contact sleeves;
   - a contact body arranged in the gap between the two contact sleeves, in a position in which it engages the extremities of both sleeves, thereby electrically bridging them, the contact body being displaceable from this position so as to interrupt the electrical contact between the two sleeves;
   - means for biasing the contact body in the sense of a displacement which causes said interruption of contact;
   - a temperature-responsive, normally solid trigger body cooperating with the contact body by holding it in place, in opposition to the biasing means, as long as the temperature remains below a predetermined level, and which, when heated to a higher temperature, softens and loses its capability of opposing the biasing means, allowing the latter to impart to the contact body said contact interrupting displacement.

2. A safety switch as defined in claim 1, wherein
   - the jacket has a generally cylindrical shape and is injection molded of a thermo-setting synthetic plastic material; and
   - the contact sleeves are permanently embedded in the jacket, their outer end portions protruding from the axial extremities of the jacket.

3. A safety switch as defined in claim 2, wherein
   - the two contact sleeves have peripheral anchoring shoulders in the form of outwardly folded wall pleats;
   - the lead-in wires are engaged a distance into the outer end portions of the associated contact sleeves; and
   - the protruding contact sleeve end portions are swaged over the engaged lead-in wire, thereby attaching and electrically connecting the wires.

4. A safety switch as defined in claim 1, wherein
   - the jacket envelops at least the inner portions of the contact sleeves, defining in the axial gap therebetween an intermediate bore portion in alignment with the bores of the contact sleeves; and
   - the contact body is cylindrical in shape having an outer diameter which displaceably engages the inner bore end portions of the contact sleeves and the intermediate bore portion of the jacket.

5. A safety switch as defined in claim 4, wherein
   - the lead-in wires are engaged a distance into the outer end portions of the contact sleeves, and fixedly connected thereto, thus forming outer end closures for the sleeve bores;
   - the biasing means includes a compression spring received in preloaded condition inside the bore of one of the contact sleeves and bearing with one end against the extremity of the associated lead-in wire; and
   - the trigger body is received in the bore of the other contact sleeve, bearing likewise against the extremity of the associated lead-in wire.

6. A safety switch as defined in claim 5, wherein
   - the contact body is a cylindrical packing containing conductive metal granulate; and
   - the biasing means further includes a plunger axially interposed between the compression spring and the contact body packing.

7. A safety switch as defined in claim 6, wherein
   - the trigger body is a non-conductive fusible granulate admixed to the metal granulate of the contact body, the contact body and the trigger body being combined to form a single composite packing which, when heated to said higher temperature, becomes axially compressible under the bias of the preloaded compression spring, allowing the spring to disengage the combined contact/trigger body from the contact sleeve which holds the spring.

8. A safety switch as defined in claim 6, wherein
   - the trigger body is a packing of non-conductive fusible granulate arranged axially adjacent the metal granulate packing between the latter and the lead-in wire, the fusible granulate packing, when heated to said higher temperature, becoming axially compressible under the bias of the preloaded compression spring, allowing the spring to disengage the contact body from the contact sleeve which holds the spring.

9. A safety switch as defined in claim 6, wherein the trigger body is a compression resistant member extending axially in the space between the contact body and the lead-in wire so as to axially abut against both, said member having wall portions which, when heated to said higher temperature, soften and yield axially in a collapsing manner, allowing the spring to disengage the contact body from the contact sleeve which holds the spring.

10. A safety switch as defined in claim 9, wherein the trigger body is a double-mushroom-shaped member, having an axially extending central stem between abutment discs; and at least the stem of said member is of fusible material and arranged to axially collapse at said higher temperature.

11. A safety switch as defined in claim 4, wherein the contact body is a cylindrical packing of conductive metal granulate;

the biasing means includes a compression spring and a plunger received in preloaded condition inside the bore of one of the contact sleeves, the spring bearing against an abutment in the outer portion of the sleeve and the plunger bearing against the contact body;

the trigger body is a disc-shaped member of fusible material engaging the contact body from the opposite side inside the other contact sleeve, thereby holding it in position against the spring bias;

the trigger body, in turn, is axially supported on its periphery by engaging an annular groove in said contact sleeve, said support failing, when the trigger body is heated to said higher temperature, as a result of softening and fusion taking place on the trigger body.

* * * * *